US010633810B2

(12) United States Patent
Pavloski et al.

(10) Patent No.: US 10,633,810 B2
(45) Date of Patent: Apr. 28, 2020

(54) WASTE COLLECTION DEVICES AND METHODS OF USE

(71) Applicants: Dennis W. Pavloski, Summit, IL (US); Dennis M. Pavloski, Orland Park, IL (US)

(72) Inventors: Dennis W. Pavloski, Summit, IL (US); Dennis M. Pavloski, Orland Park, IL (US)

( * ) Notice: Subject to any disclaimer, the term of this patent is extended or adjusted under 35 U.S.C. 154(b) by 11 days.

(21) Appl. No.: 16/153,337

(22) Filed: Oct. 5, 2018

(65) Prior Publication Data

US 2019/0106851 A1 Apr. 11, 2019

Related U.S. Application Data

(60) Provisional application No. 62/569,016, filed on Oct. 6, 2017, provisional application No. 62/643,344, filed on Mar. 15, 2018.

(51) Int. Cl.
*E01H 1/12* (2006.01)

(52) U.S. Cl.
CPC ..... *E01H 1/1206* (2013.01); *E01H 2001/122* (2013.01); *E01H 2001/1293* (2013.01)

(58) Field of Classification Search
CPC ..... E01H 1/1206; E01H 2001/122
USPC ..... 294/1.3, 1.4, 1.5, 176; 15/257.1, 257.3
See application file for complete search history.

(56) References Cited

U.S. PATENT DOCUMENTS 4,149,745 A * 4/1979 Willis ..... E01H 1/1206 15/257.1
4,200,321 A * 4/1980 Warkentin ..... E01H 1/1206 15/104.8
D298,369 S * 11/1988 Shun ..... 294/1.4
5,423,586 A * 6/1995 Fuller ..... A45C 3/00 294/149
D367,746 S * 3/1996 Walker, Jr. ..... D34/5
5,575,520 A * 11/1996 Northcutt ..... A01K 1/01 141/108
5,899,510 A * 5/1999 Hayes ..... E01H 1/1206 294/1.4
D461,027 S * 7/2002 Gardner ..... D30/162
7,686,360 B2 * 3/2010 Platt ..... A01K 1/0114 294/1.3
D635,310 S * 3/2011 Jessmon ..... D30/162
8,201,863 B1 * 6/2012 Konovalov ..... E01H 1/006 15/79.1
9,133,592 B2 * 9/2015 Becattini, Jr. ..... E01H 1/1206
D828,652 S * 9/2018 Ausere ..... D30/162
2002/0185874 A1 * 12/2002 Arceo ..... E01H 1/1206 294/1.4

(Continued)

*Primary Examiner* — Paul T Chin
(74) *Attorney, Agent, or Firm* — Hartman Global IP Law; Gary M. Hartman; Domenica N. S. Hartman

(57) ABSTRACT

Devices and methods suitable for collecting and disposing of waste, preferably from a standing position, with relatively little effort. Such a device includes a tubular body having a lowermost side, an uppermost side, and front and rear openings at front and rear axial ends thereof, respectively. A handle is secured to the body by an extension member so as to be ergonomic in relation to the body. The tubular body is configured to collect waste through the front opening and transfer the waste through the rear opening and into a container coupled to the rear end of the tubular body.

20 Claims, 7 Drawing Sheets

(56) References Cited

U.S. PATENT DOCUMENTS

| | | | | |
|---|---|---|---|---|
| 2005/0184540 | A1* | 8/2005 | Graziosi | A01K 23/005 294/1.4 |
| 2005/0264016 | A1* | 12/2005 | Davis | E01H 1/1206 294/1.3 |
| 2006/0180512 | A1* | 8/2006 | Allen | A01B 1/00 209/418 |
| 2006/0214440 | A1* | 9/2006 | Thomann | E01H 1/1206 294/1.3 |
| 2011/0254296 | A1* | 10/2011 | Chavez | E01H 1/1206 294/1.3 |
| 2014/0327256 | A1* | 11/2014 | Zurn | E01H 1/1206 294/1.4 |

* cited by examiner

WASTE COLLECTION DEVICES AND METHODS OF USE

CROSS REFERENCE TO RELATED APPLICATIONS

This application claims the benefit of U.S. Provisional Application No. 62/569,016 filed Oct. 6, 2017, and U.S. Provisional Application No. 62/643,344 filed Mar. 15, 2018. The contents of these prior applications are incorporated herein by reference.

BACKGROUND OF THE INVENTION

The present invention generally relates to waste collection and disposal. The invention particularly relates to methods and hand-operated devices intended to be used by individuals to collect waste or refuse, such as but not limited to animal excrement, and to dispose the waste or refuse in a sanitary manner.

Various types of waste collection devices are commercially available which are intended to assist in the collection and removal of pet excrement (droppings). However, such devices are commonly difficult to use and/or require the user to bend at the waist or knees, which may be uncomfortable or difficult for certain individuals, such as an elderly person.

In view of the above, there is an ongoing desire for methods and devices capable of collecting and disposing of waste while reducing the effort required by individuals during their use.

BRIEF DESCRIPTION OF THE INVENTION

The present invention provides devices and methods suitable for collecting and disposing of waste, preferably from a standing position, with relatively little effort.

According to one aspect of the invention, a waste collection device is provided that includes a tubular body having a lowermost side, an uppermost side, and front and rear openings at front and rear axial ends thereof, respectively. A handle is secured to the body by an extension member so as to be ergonomic in relation to the body. Means is provided for coupling a container to the rear end of the tubular body. The tubular body is configured to collect waste through the front opening and transfer the waste through the rear opening and into the container.

According to another aspect of the invention, a method of using the waste collection device includes attaching the container to the rear end of the tubular body, collecting waste through the front opening of the tubular body such that the waste is transferred from the tubular body and through the rear opening to the container, removing the container from the tubular body, and disposing the container and the waste located therein.

Technical effects of devices and methods as described above preferably include the ability to collect and dispose of waste with reduced effort relative to currently existing devices and methods.

Other aspects and advantages of this invention will be further appreciated from the following detailed description.

DETAILED DESCRIPTION OF THE INVENTION

Figure 1:
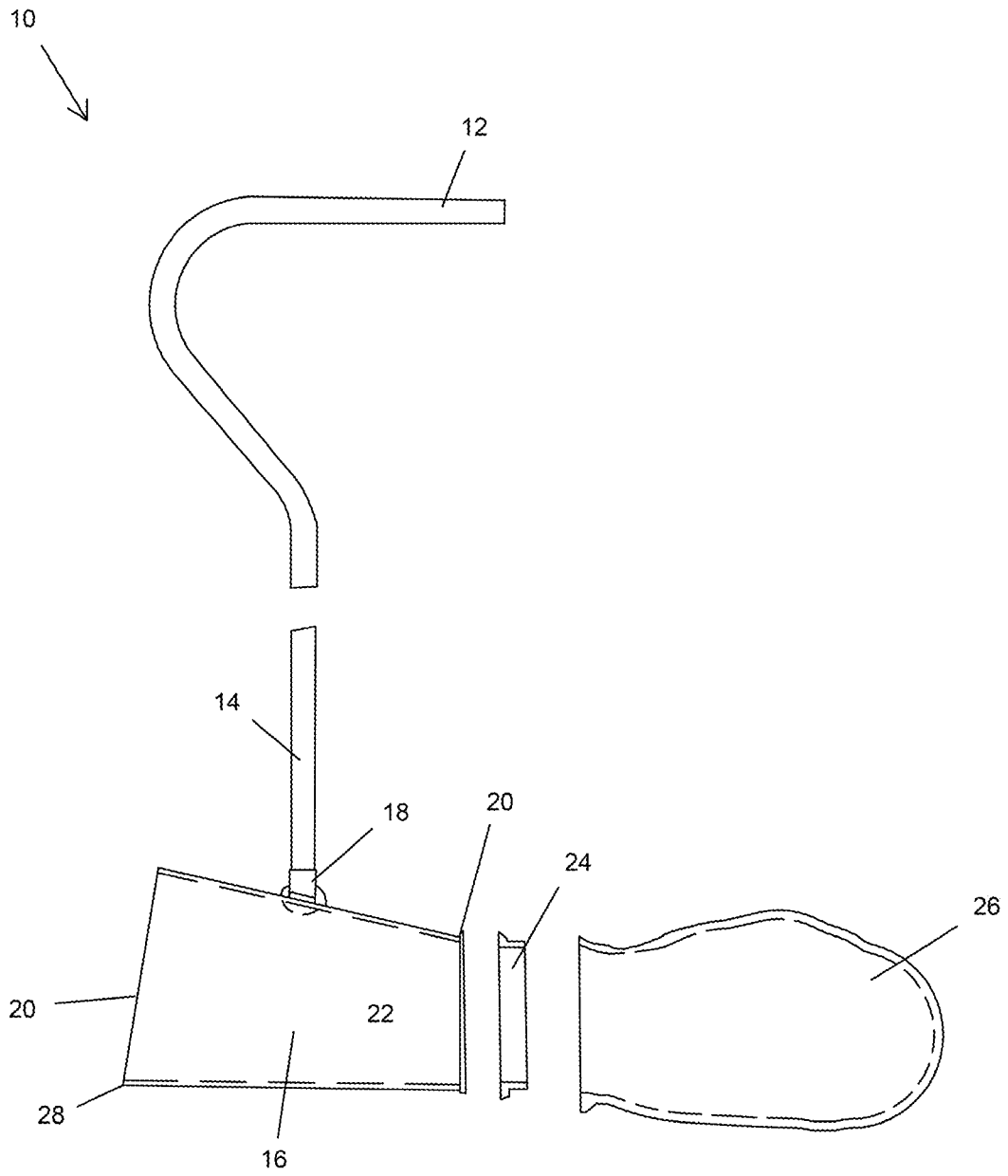
FIG. 1 schematically represents a fragmentary side view of a waste collection device comprising a handle secured to a tubular body in accordance with a first nonlimiting embodiment of this invention.

FIGS. 1 through 10 schematically represent various aspects of nonlimiting embodiments of waste collection devices 10. The devices 10 are intended to be used by an individual to collect waste or refuse, particularly but not limited to pet excrement (droppings). To facilitate the description provided below of the embodiments represented in the drawings, relative terms, including but not limited to, "vertical," "horizontal," "lateral," "front," "rear," "side," "forward," "rearward," "upper," "lower," "above," "below," "right," "left," etc., may be used in reference to an orientation of the devices 10 during their use, and therefore are relative terms that are useful to describe the devices 10 represented in the drawings and help to define the scope of the invention.

Figure 2:
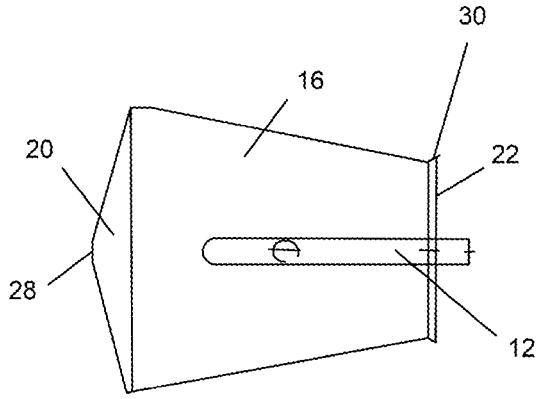
FIGS. 2 and 3 schematically represent, respectively, a top view of the waste collection device of FIG. 1 and a fragmentary front view of the tubular body thereof.
Figure 3:
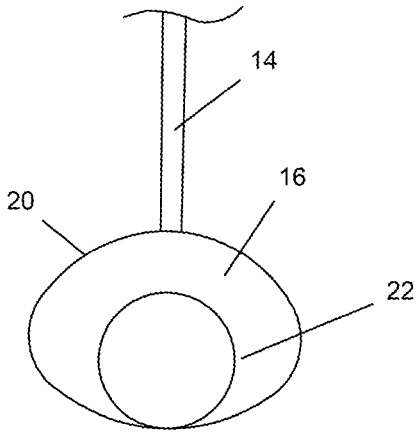

FIGS. 1 through 3 schematically represent various aspects of a first nonlimiting embodiment of a waste collection device 10. The waste collection device 10 includes a hollow, tapered tubular body 16 coupled to a handle 12 by an extension member 14 that may include means for adjusting its length and thereby a distance between the handle 12 and tubular body 16. The tubular body 16 includes a front opening 20 at a front end (entrance) to the body 16 and a rear opening 22 at a rear end (exit) of the body 16, all of which are generally disposed along an axis of the tubular body 16. The tubular body 16 has a frustoconical shape such that the front opening 20 is larger than the rear opening 22. The extension member 14 may be secured, either permanently or releasably, to an uppermost side of the tubular body 16 by any suitable means. For example, the extension member 14 may be secured to the tubular body 16 with a welded mechanical attachment, mechanical fastener, or compression coupling 18. In view of its configuration and orientation as seen in FIG. 1, the lowermost side of the tubular body 16 (i.e., the side of the body 16 opposite the extension member 14) is intended to be engaged with the ground when using the device 10 to collect waste located on the ground.

The tubular body 16 is adapted to removably couple a container 26, preferably a disposable container 26 such as a flexible plastic bag, to the rear end thereof such that an opening of the container 26 is aligned with and adjoins the rear opening 22 of the device 10. The tubular body 16 may be attached to the container 26 by any suitable means. As a nonlimiting example, the device 10 may include an attachment member 24 configured to threadably mate with a flange 30 located at the rear end of the tubular body 16, and thereby releasably secure the container 26 to the tubular body 16 with the rim of the container 26 surrounding the rear opening 22 and clamped between the flange 30 and attachment member 24. A specific nonlimiting example of the attachment member 24 includes a configuration substantially identical to a conventional canning lid.

During use, an individual may collect waste by securing the container 26 to the tubular body 16, and then causing the waste to enter the front opening 20 of the tubular body 16, and thereafter cause the waste to move through the tubular body 16 and enter the container 26 through the rear opening 22 of the tubular body 16. For example, the tubular body 16 can be tilted so that gravitational forces cause the waste to travel downward through the tubular body 16 into the container 26. Thereafter, the individual may decouple the container 26 from the tubular body 16 and then dispose of the container 26 and the waste contained therein. Preferably, the device 10 promotes the ability of the individual to perform the above steps from a standing position. For example, the extension member 14 preferably has a longitudinal length sufficient such that the individual is able to collect waste located on the ground with the device 10 without the need for the individual to bend at their waist or knees. The length of the extension member 14 may be adjustable, as a nonlimiting example, by fabricating the extension member 14 in two sections that can be caused to translate relative to each other.

The tubular body 16 is preferably tapered in a manner as represented in FIGS. 1 through 3 to promote the collection and transfer of waste to the container 26. As a result, the front opening 20 can be relatively large in order to provide sufficient space to collect larger waste, such as dropping from a relatively large dog, whereas the rear opening 22 can be relatively smaller to accommodate various types of containers 26, which may have smaller openings than the front opening 20 of the tubular body 16. The front opening 20 may optionally be angled relative to the longitudinal axis of the tubular body 16, such that a lower edge of the tubular body 16 at its front opening 20 protrudes farther from the tubular body 16 than the uppermost side of the tubular body 16 at the front opening 20, as represented in FIGS. 1 and 2. The front opening 20 may be shaped to have a lowermost tapered edge that terminates at a point 28 at the lowermost side of the opening 20 to promote insertion of the lowermost edge below waste, for example, by wedging or working the point 28 below waste located on the ground. Alternatively, the front opening 20 may be shaped to include one or more finger-like members suitable for scooping waste.

Collection of the waste may be further promoted by forming the handle 12 and the extension member 14 to individually or collectively have shapes that are ergonomic in relation to the operation of the tubular body 16. For example, FIG. 1 represents the handle 12 as having a longitudinal axis that is parallel to the lowermost side (bottom) of the tubular body 16, and positioned to be generally directly above the center of mass of the tubular body 16. Specifically, the extension member 14 extends from a substantially centered position on the tubular body 16 and curves rearward toward the rear end of the tubular body 16 such that all portions of the handle 12 and extension member 14 are coplanar with a longitudinal axis of the tubular body 16. In such an embodiment, if the front opening 20 is larger than the rear opening 22, the uppermost side of the tubular body 16 is preferably sloped and attached to the extension member 14 at an angle such that the lowermost side of the tubular body 16 is flat or horizontal to ground when in use. Such an ergonomic configuration is believed to reduce the necessary range of motion and physical effort performed by an individual when collecting waste with the device 10.

The device 10 and its components may be formed of various materials, including polymeric and/or metallic materials. As a nonlimiting example, the device 10 and its components may be formed of aluminum, steel, or another iron alloy, which may be coated or treated to prevent corrosion. According to a specific nonlimiting example, the tubular body 16 may be formed of twenty-four gauge galvanized steel.

Figure 4:
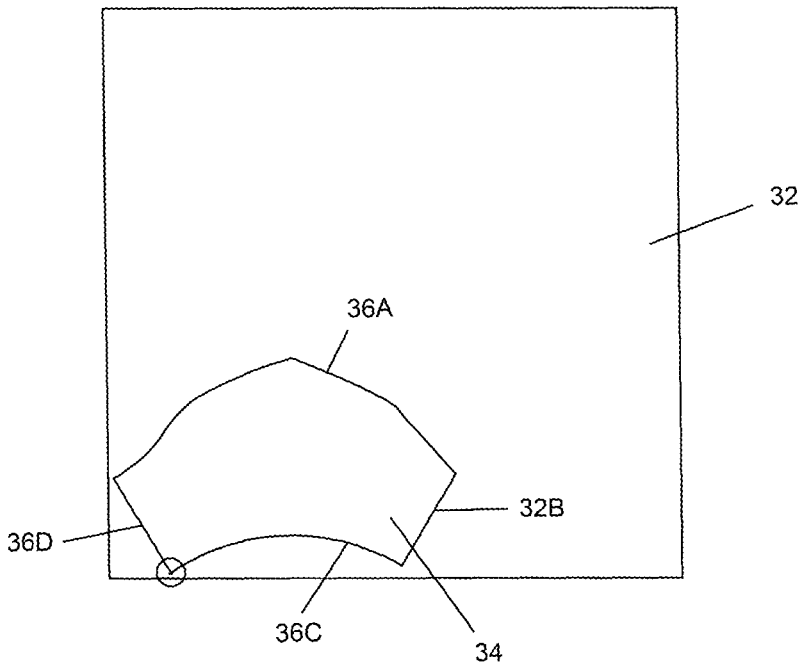
FIG. 4 schematically represents a plan view of a sheet of metal and a portion cut therefrom that is shaped to produce the tubular body of the waste collection device of FIGS. 1 to 3.

FIG. 4 schematically represents a planar sheet of metal 32 from which a portion 34 may be cut to fabricate the tubular body 16 of the device 10. The portion 34 includes first, second, third, and fourth edges 36A, 36B, 36C, and 36D, respectively. Once removed from the sheet of metal 32, the portion 34 may be rolled into a tubular shape to define the tubular body 16, wherein the first and third edges 36A and 36C form the front and rear openings 20 and 22, respectively, and the second and fourth edges 36B and 36D meet such that the portion 34 forms the sides of the tubular body 16. In the embodiment represented in FIG. 4, the first side 36A is shaped such that, once the portion 34 has been rolled to define the tubular body 16, the front opening 20 thereof includes the point 28 at the lowermost side of the opening 20.

FIGS. 5 through 10 depict additional configurations of waste collection devices 10 in accordance with further embodiments of this invention. In these figures, consistent reference numbers are used to identify the same or functionally equivalent elements. In view of similarities between the embodiments, the following discussion of FIGS. 5 through 10 will focus primarily on aspects of their illustrated embodiments that differ from the first embodiment of FIGS. 1 through 4 in some notable or significant manner. Other aspects of the additional embodiments not discussed in any detail can be, in terms of structure, function, materials, etc., essentially as was described for the first embodiment.

Figure 5:
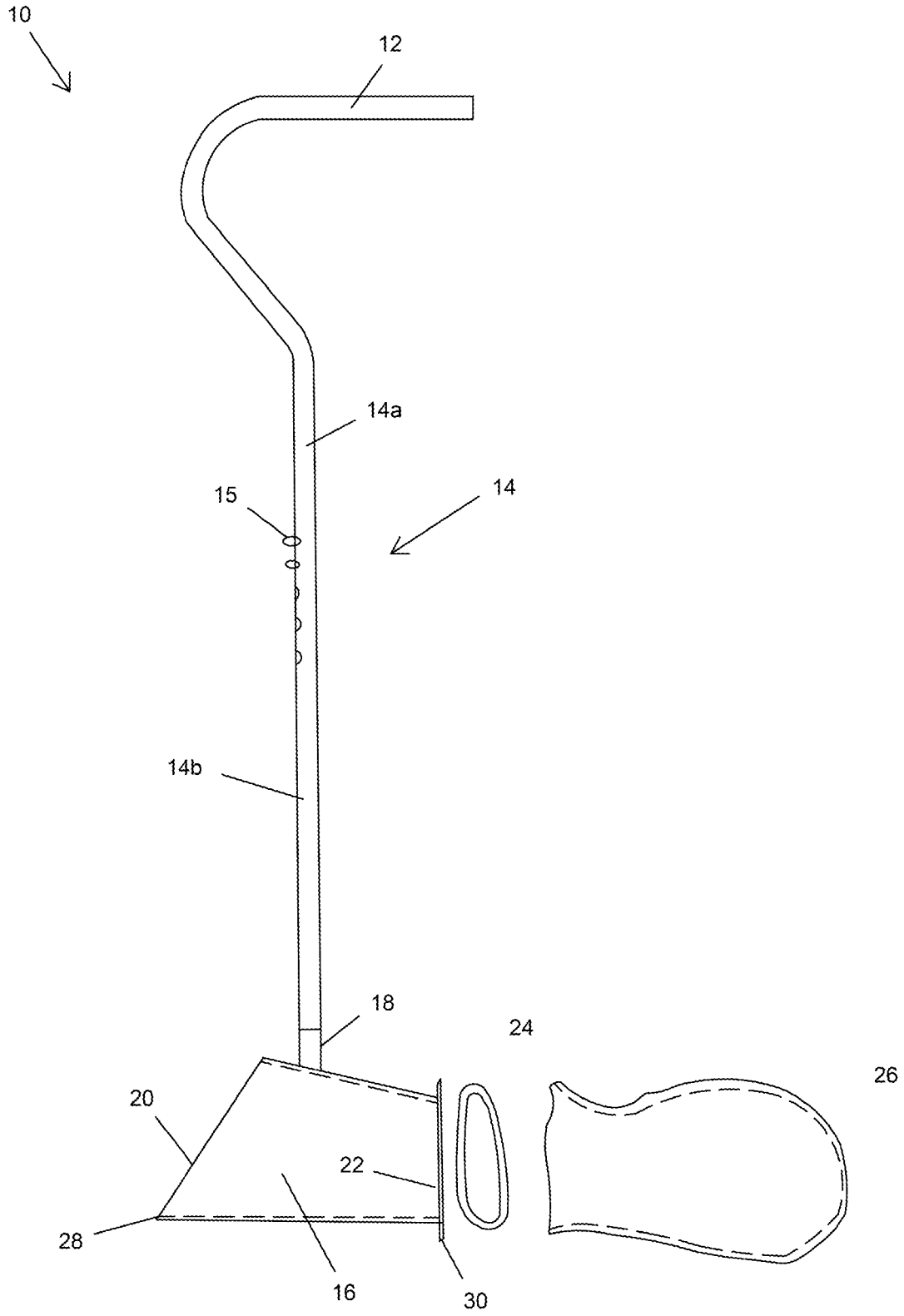
FIG. 5 schematically represents a side view of a waste collection device comprising a handle secured to a tubular body in accordance with a second nonlimiting embodiment of this invention.

In FIG. 5, the extension member 14 of the waste collection device 10 comprises multiple assembled sections that may be retractable/extendable relative to one another providing the capability of having an adjustable length. For example, the extension member 14 includes an upper member 14*a* and a lower member 14*b* wherein the upper member 14*a* is retractable within the lower member 14*b* (alternatively vice versa), and the relative retracted position of the upper member 14*a* within the lower member 14*b* may be secured with a locking mechanism comprising a biased compressible button or pin 15 coupled to the lower member 14*b* and sized to protrude through holes formed along vertical portions of the upper member 14*a* to releasably fix the longitudinal length of the extension member 14.

The tubular body 16 is represented in FIG. 5 as attaching to the container 26 by the attachment member 24 that, according to a second nonlimiting embodiment, may be an elastic band, ring, or the like that is configured to elastically expand to a diameter greater than that of the flange 30, be located at the rear end of the tubular body 16, and contract to a diameter that is less than that of the flange 30. As such, the attachment member 24 is adapted to releasably secure the container 26 to the tubular body 16 with the rim of the container 26 surrounding the rear opening 22 and clamped between the rear end of the tubular body 16 and attachment member 24.

Figure 6:
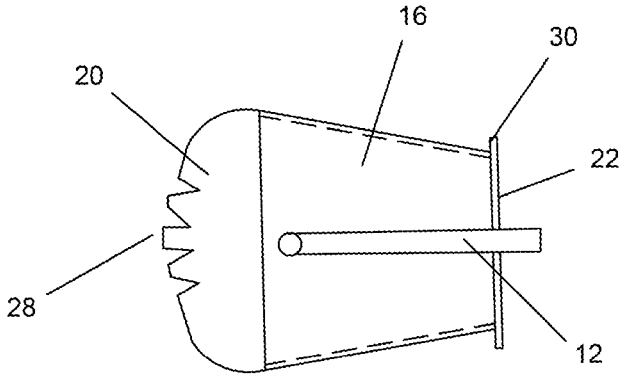
FIG. 6 schematically represents a top view of the waste collection device of FIG. 5.

FIGS. 5 and 6 represent the front opening 20 as having an angle of taper relative to the longitudinal axis of the tubular body 16 that is greater than the angle of taper represented in FIGS. 1 and 2. The increased angle of taper may provide an improved view of the point 28 and adjacent surfaces within the front end of the front opening 20 during use, as evident from FIG. 6.

Figure 7:
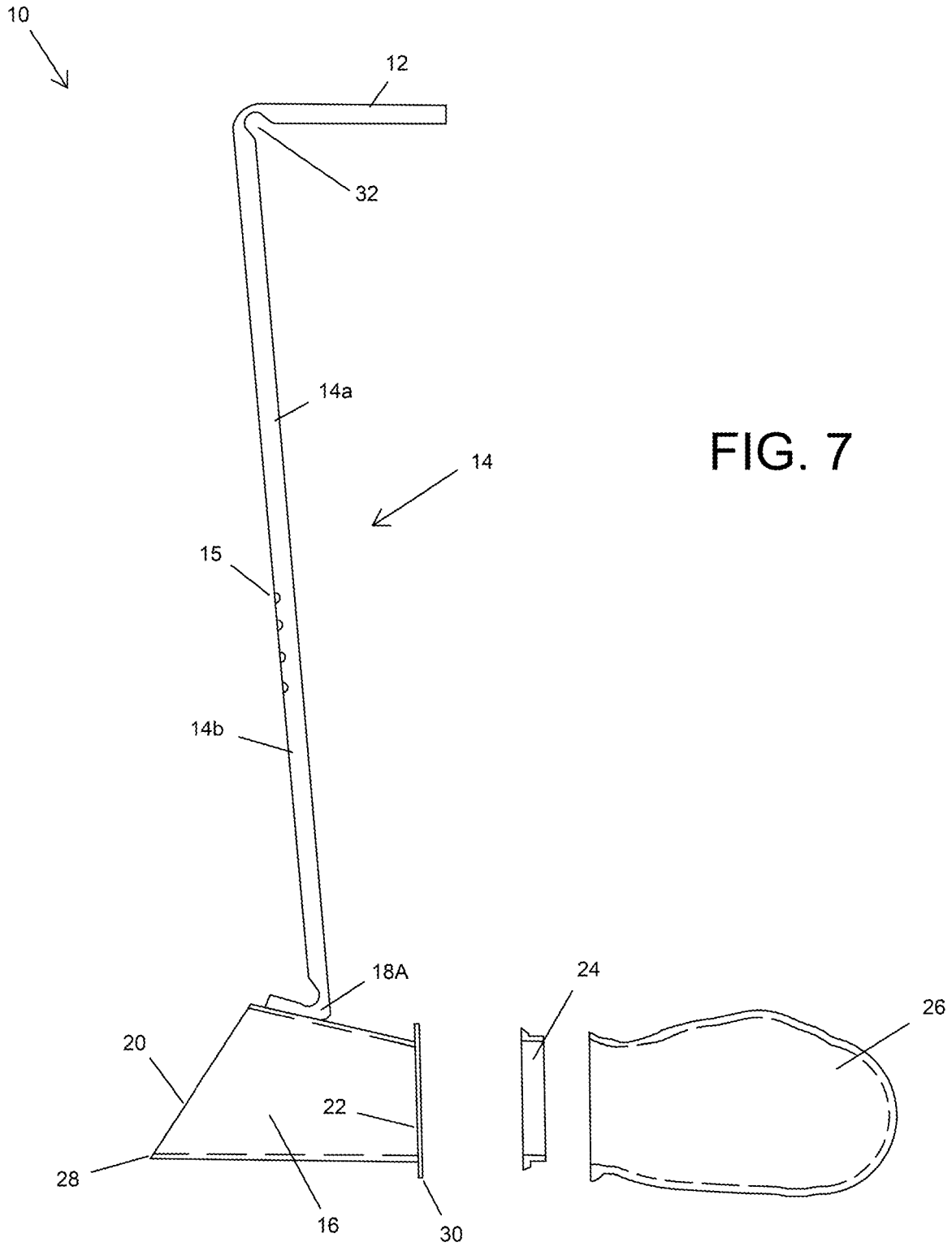
FIG. 7 schematically represents a side view of a waste collection device comprising a handle secured to a tubular body in accordance with a third nonlimiting embodiment of this invention.

FIG. 7 represents another waste collection device 10 whose tubular body 16 has a front opening 20 with an angle of taper similar to that of FIGS. 5 and 6, but whose attachment member 24 is similar to that of FIG. 1. FIG. 7 further represents the extension member 14 as having a multiple-piece construction similar to that described for FIGS. 5 and 6. The handle 12 and extension member 14 of FIG. 7 differ from the prior embodiments by orienting the extension member 14 at an angle other than ninety degrees to the tubular body 16, orienting the handle 12 approximately ninety degrees to the extension member 14, providing an ergonomic finger hold 32 at the juncture between the handle 12 and extension member 14, and providing an overlap seam 18A with which the extension member 14 can be secured to the tubular body 16 with fasteners.

Figure 8:
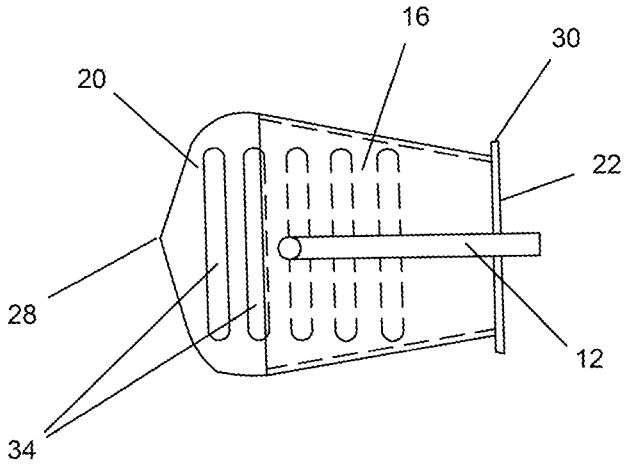
FIG. 8 schematically represents a top view of an alternative configuration for the tubular bodies of any of the first, second, and third embodiments of FIGS. 1 through 7.

FIG. 8 represents a tubular body 16 suitable for use with any of the waste collection devices 10 represented in FIGS. 1 through 7, but modified as a result of the lowermost side of the tubular body 16 having sieving openings 34 defined therein. The sieving openings 34 are shown as an array of slots aligned in a direction parallel to the axis of the tubular body 16. The array is closer to the front opening 20 of the tubular body 16 than the rear opening 22 of the body 16, and therefore axially spaced apart from the rear opening 22 and a container 26 (e.g., plastic bag) attached thereto. Each slot extends in a direction transverse (e.g., perpendicular) to the axis of the tubular body 16, and encompasses nearly the entire transverse width of the body 16. This embodiment is particularly well suited for extracting waste from a loose material, such as cat litter, sand, or other granular material.

Figure 9:
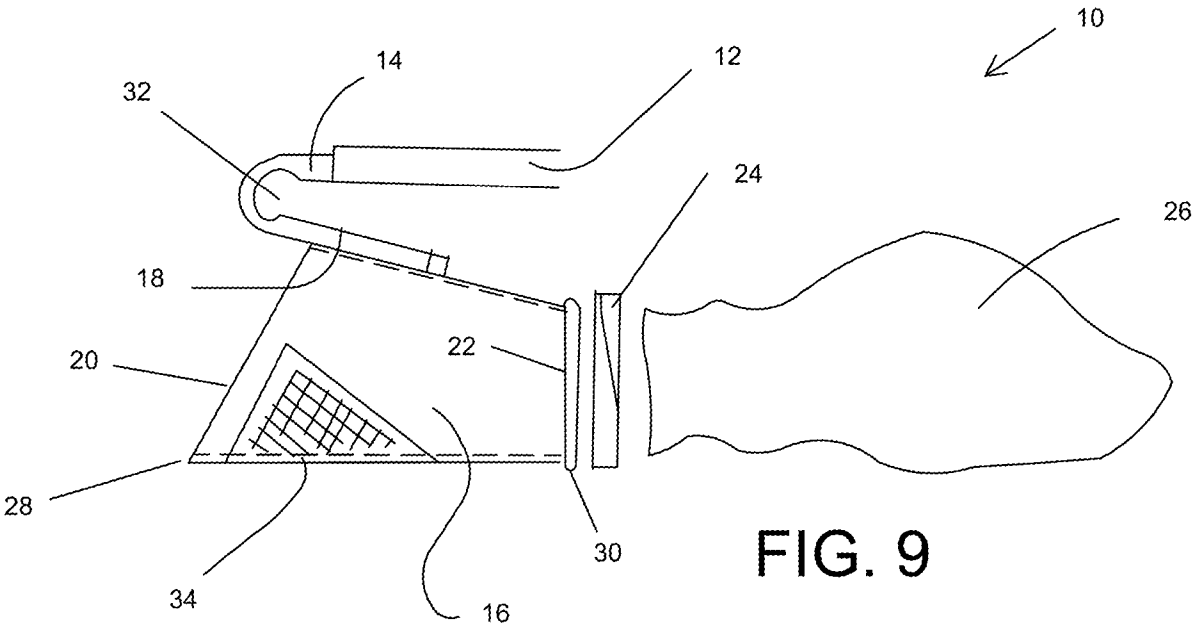
FIGS. 9 and 10 schematically represent side and top views, respectively, of a waste collection device comprising a handle secured to a tubular body in accordance with a fourth nonlimiting embodiment of this invention.
Figure 10:
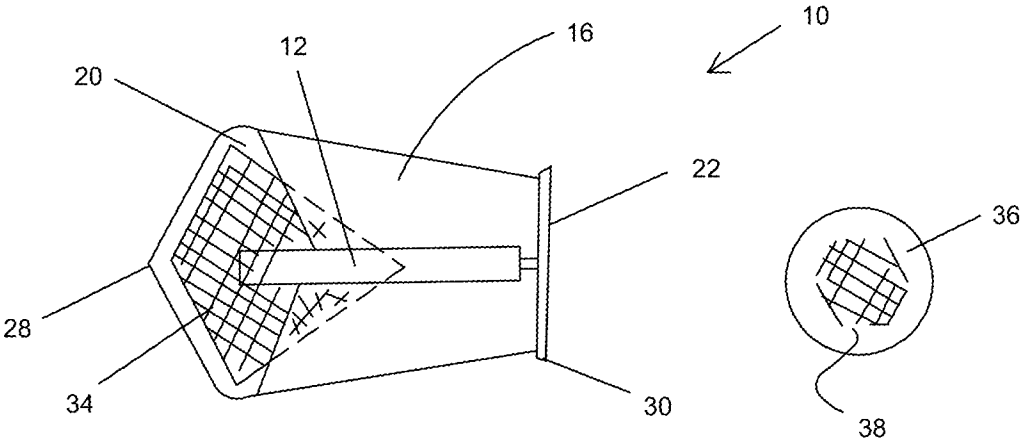

FIGS. 9 and 10 schematically represent side and top views, respectively, of another waste collection device 10 whose tubular body 16 includes sieving openings 34 on its lowermost side. The sieving openings 34 are shown as apertures of a screen, represented as having a border that generally has a diamond shape when viewed from above (FIG. 10), though other shapes are foreseeable. The screen is proximate the front end of the tubular body 16 so as to be closer to the front opening 20 of the tubular body 16 than the rear opening 22, and therefore axially spaced apart from the rear opening 22 and the container 26 (e.g., plastic bag) attached thereto. The device 10 of FIGS. 9 and 10 further differs from prior embodiments by incorporating a shorter extension member 14, such that the handle 12 is in close proximity to the tubular body 16. In addition, FIG. 10 depicts the device 10 as equipped with a closure 36 configured to be retained with the attachment member 24 to cover the rear opening 22 of the tubular body 16 in place of the container 26. The closure 36 may be porous as a result of comprising a mess or screen 38 as shown for performing a sieving operation, though the provision of a blind (nonporous) closure is also within the scope of the invention. The closure 36 can be used as a substitute for the container 26 in the event that the device 10 is to be used to remove droppings from cat litter or other granular material. If the closure 36 is a blind closure, the location of the sieving openings 34 away from the closed rear opening 22 enables the end of the tubular body 16 adjacent the rear opening 22 to completely contain and retain the material collected by the device 10.

It should be appreciated that any of the embodiments of the waste collection devices 10 represented in FIGS. 1 through 10 can be configured to include or lack sieving openings 34 of the types represented in FIGS. 8, 9, and 10.

In view of the above, the devices 10 of FIGS. 1 through 10 provide for sanitary waste removal that enables a user to collect and dispose of waste without directly contacting the waste, and preferably with minimal effort or discomfort.

While the invention has been described in terms of particular embodiments and investigations, it should be apparent that alternatives could be adopted by one skilled in the art. For example, the devices 10 and their components could differ in appearance and construction from the embodiments described herein and shown in the drawings, functions of certain components of the devices 10 could be performed by components of different construction but capable of a similar (though not necessarily equivalent) function, and appropriate materials could be substituted for those noted. As such, it should be understood that the above detailed description is intended to describe the particular embodiments represented in the drawings and certain but not necessarily all features and aspects thereof, and to identify certain but not necessarily all alternatives to the embodiments and their described features and aspects. As a non-limiting example, the invention encompasses additional or alternative embodiments in which one or more features or aspects of a particular embodiment could be eliminated or two or more features or aspects of different embodiments could be combined. Accordingly, it should be understood that the invention is not necessarily limited to any embodiment described herein or illustrated in the drawings, and the phraseology and terminology employed above are for the purpose of describing the illustrated embodiments and investigations and do not necessarily serve as limitations to the scope of the invention. Therefore, the scope of the invention is to be limited only by the following claims.

The invention claimed is:

1. A waste collection device comprising:

a tubular body having a longitudinal axis, a lowermost side, an uppermost side, and front and rear openings at front and rear axial ends thereof, respectively;

a handle secured to the tubular body by an extension member between the tubular body and the handle and attached to the tubular body, the handle and the extension member being ergonomic in relation to the tubular body as a result of the handle being positioned directly above the center of mass of the tubular body and at least a portion of the extension member extending in a direction toward the front axial end of the tubular body before adjoining the handle; and an attachment member for coupling a container to the rear end of the tubular body so that an opening of the container surrounds the rear opening of the tubular body;

wherein the tubular body is configured to collect waste at the front opening and transfer the waste through the rear opening and into the container.

2. The waste collection device of claim 1, wherein the tubular body has a frustoconical shape and the front opening is larger than the rear opening.

3. The waste collection device of claim 1, wherein the front opening of the tubular body is shaped to have a lowermost linearly tapered edge that terminates at an angular point at the lowermost side of the tubular body, the point protruding farther from the tubular body than the uppermost side of the tubular body.

4. The waste collection device of claim 1, wherein the rear end of the tubular body includes a flange configured to releasably couple with the attachment member in order to secure the container to the rear end of the tubular body.

5. The waste collection device of claim 1, wherein the handle has a longitudinal axis that is parallel to the lowermost side of the tubular body.

6. The waste collection device of claim 1, wherein the extension member has an adjustable longitudinal length.

7. The waste collection device of claim 1, wherein the lowermost side of the tubular body has sieving openings therein.

8. The waste collection device of claim 7, wherein the sieving openings are closer to the front end of the tubular body than to the rear end thereof.

9. The waste collection device of claim 7, wherein the sieving openings are defined by a screen.

10. The waste collection device of claim 7, wherein the sieving openings are defined by an array of slots that is aligned in a direction parallel to the longitudinal axis of the tubular body and comprises individual slots that extend in a direction transverse to the longitudinal axis of the tubular body.

11. The waste collection device of claim 1, further comprising a closure for closing the rear opening of the tubular body, the attachment member being operable to retain the closure to cover the rear opening of the tubular body in place of the container.

12. The waste collection device of claim 11, wherein the closure is a blind closure.

13. The waste collection device of claim 11, wherein the closure is a porous closure.

14. A method of using the waste collection device of claim 1, the method comprising the steps of:

attaching the container to the rear end of the tubular body;

collecting waste through the front opening of the tubular body such that the waste is transferred from the tubular body and through the rear opening to the container;

removing the container from the tubular body; and disposing the container and the waste located therein.

15. The method of claim 14, wherein the waste collecting step is performed from a standing position without bending at the waist or knees.

16. The method of claim 14, wherein the lowermost side of the tubular body has sieving openings therein and the method further comprises sieving a granular material from the waste while the waste is located in the tubular body.

17. A waste collection device comprising:

a tubular body having a longitudinal axis, a lowermost side, an uppermost side, and front and rear openings at front and rear axial ends thereof, respectively;

a handle secured to the tubular body by an extension member between the tubular body and the handle and attached to the tubular body;

a container and an attachment member coupling the container to the rear end of the tubular body so that an opening of the container surrounds the rear opening of the tubular body; and a closure for closing the rear opening of the tubular body, the attachment member being operable to retain the closure to cover the rear opening of the tubular body in place of the container;

wherein the tubular body is configured to collect waste at the front opening and transfer the waste through the rear opening and into the container.

18. The waste collection device of claim 17, wherein the handle and the extension member are ergonomic in relation to the tubular body as a result of the handle having a longitudinal axis that is parallel to the lowermost side of the tubular body, the handle being positioned directly above the center of mass of the tubular body, and at least a portion of the extension member extending in a direction toward the front axial end of the tubular body before adjoining the handle.

19. The waste collection device of claim 17, wherein the extension member entirely extends in the direction toward the front axial end of the tubular body before adjoining the handle.

20. The waste collection device of claim 17, wherein the lowermost side of the tubular body has sieving openings therein, the sieving openings are closer to the front end of the tubular body than to the rear end thereof.

* * * * *